US006466737B1

(12) United States Patent
Birdsell et al.

(10) Patent No.: US 6,466,737 B1
(45) Date of Patent: Oct. 15, 2002

(54) PORTABLE ELECTRIC SPACE HEATER

(75) Inventors: Walter G. Birdsell, Marlborough, MA (US); Bruce Chute, Northboro, MA (US)

(73) Assignee: Honeywell Consumer Products, Inc., Southborough, MA (US)

( * ) Notice: Subject to any disclaimer, the term of this patent is extended or adjusted under 35 U.S.C. 154(b) by 0 days.

(21) Appl. No.: 09/991,468

(22) Filed: Nov. 21, 2001

(51) Int. Cl.[7] ..... F24H 3/00

(52) U.S. Cl. ..... 392/367; 392/365; 219/476; 219/526; 219/524

(58) Field of Search ..... 392/365–369, 392/379–385, 440, 413, 411–412, 414–415, 437, 373–376; 219/476–478, 537, 525, 536; 416/120, 247 R, 246, 244 R; 415/60; D23/317, 332–340, 380; 362/250, 227

(56) References Cited

U.S. PATENT DOCUMENTS

| | | | |
|---|---|---|---|
| 323,018 | A | 7/1885 | Atkins |
| 1,217,607 | A | 2/1917 | Karl |
| 1,414,843 | A | 5/1922 | Voss |
| 2,010,901 | A | 8/1935 | Schramm |
| 2,041,897 | A | 5/1936 | Benson |
| 2,051,456 | A | 8/1936 | Muir et al. |
| 2,131,484 | A | 9/1938 | Ringwald |
| 2,162,341 | A | 6/1939 | Adam |
| 2,167,122 | A | 7/1939 | Metcalf |
| 2,188,122 | A | 1/1940 | Steingruber |
| 2,198,694 | A | 4/1940 | Barnes |
| 2,232,492 | A | 2/1941 | Steingruber |
| 2,234,373 | A | 3/1941 | Gough |
| 2,255,759 | A | 9/1941 | Carpenter |
| 2,316,563 | A | 4/1943 | Clemons |
| 2,318,777 | A | 5/1943 | Hill et al. |
| 2,329,592 | A | 9/1943 | Clemons |
| 2,334,501 | A | 11/1943 | Moeller |
| 2,353,247 | A | 7/1944 | Kuettel |

(List continued on next page.)

FOREIGN PATENT DOCUMENTS

| | | | |
|---|---|---|---|
| DE | 3709331 A1 | | 9/1988 |
| EP | 0493147 A1 | | 7/1992 |
| FR | 1289267 | | 2/1962 |
| FR | 2672078 | | 7/1992 |
| GB | 918553 | * | 2/1963 |
| WO | 84/03325 | | 8/1984 |

OTHER PUBLICATIONS

Herrington Catalog, p. 1, Christmas Eve 2001, USA.

*Primary Examiner*—John A. Jeffrey
(74) *Attorney, Agent, or Firm*—Wolf, Greenfield & Sacks, P.C.

(57) ABSTRACT

A method and apparatus for conditioning air includes conditioning units that are removably attached together. The conditioning units may be separated from each other and individually perform conditioning functions, such as air moving, heating, humidifying or cooling.

38 Claims, 6 Drawing Sheets

U.S. PATENT DOCUMENTS 2,410,211 A 10/1946 Gough
2,425,702 A 8/1947 Marr
2,433,137 A 12/1947 Marr
2,438,861 A 3/1948 Neiser
2,440,018 A 4/1948 Oetjen
2,445,250 A 7/1948 Steingruber
2,456,781 A 12/1948 Hardey
2,469,234 A 5/1949 Lindberg et al.
2,475,113 A 7/1949 Stiles
2,475,180 A 7/1949 Fitch
2,475,910 A 7/1949 Morrison
2,479,425 A 8/1949 Steingruber
2,523,353 A * 9/1950 Boester ..... 392/437
2,523,787 A 9/1950 Spooner, Jr.
2,562,436 A 7/1951 Pass
2,579,127 A 12/1951 Pendergast et al.
2,583,754 A 1/1952 Theisen
2,590,417 A * 3/1952 Jones ..... 392/415
2,612,591 A 9/1952 McFarland
2,631,217 A 3/1953 Aufiero
2,668,220 A 2/1954 Spurr
2,707,745 A 5/1955 Farr et al.
2,727,978 A 12/1955 Beckett et al.
2,852,657 A 9/1958 Markel et al.
2,883,512 A 4/1959 Winther
3,051,820 A 8/1962 Krichton
3,059,090 A 10/1962 Waters
3,069,525 A 12/1962 Waters
3,175,550 A 3/1965 Knapp
3,189,727 A 6/1965 Jepson et al.
3,240,915 A * 3/1966 Carter et al. ..... 392/411
3,610,882 A 10/1971 Omohundro
3,619,563 A * 11/1971 Hirst ..... 219/386
3,624,351 A 11/1971 Kipp
3,627,959 A 12/1971 Chapell
3,632,981 A 1/1972 Gasparaitis
3,683,594 A * 8/1972 Schouw ..... 55/223
3,921,254 A 11/1975 Foster, Jr. et al.
4,074,110 A * 2/1978 Slaughter ..... 219/240
4,091,263 A 5/1978 Landeroin-Duvernois
4,138,988 A 2/1979 Hurley
4,194,104 A 3/1980 Stenta
4,244,081 A 1/1981 Beyer et al.
4,302,800 A * 11/1981 Pelletier ..... 362/250
4,309,593 A 1/1982 Jones et al.
4,362,090 A 12/1982 Whiteley
4,453,294 A 6/1984 Morita
4,481,792 A 11/1984 Groeger et al.
4,523,083 A 6/1985 Hamilton
4,591,697 A * 5/1986 Lexer ..... 392/412
4,603,452 A 8/1986 Paciorek
4,713,861 A 12/1987 Bancroft
4,821,535 A 4/1989 Wassilak et al.
4,825,526 A 5/1989 Shenier et al.
4,835,367 A 5/1989 Hoffman
4,875,721 A 10/1989 Okamoto et al.
4,886,233 A * 12/1989 Bateman et al. ..... 248/647
5,033,161 A 7/1991 Chavez
5,381,509 A 1/1995 Mills
5,437,001 A 7/1995 Chaney et al.
5,451,743 A * 9/1995 Preez ..... 219/200
5,611,120 A 3/1997 Riceman et al.
5,621,846 A 4/1997 Smith et al.
5,652,826 A 7/1997 Mills
5,689,980 A 11/1997 Weinerman et al.
5,716,271 A 2/1998 Paidosh
5,761,377 A 6/1998 Wolfe et al.
5,810,709 A 9/1998 Simenauer et al.
5,837,972 A * 11/1998 Padilla ..... 219/225
5,838,878 A 11/1998 Jane et al.
5,940,934 A 8/1999 Turner
6,122,437 A 9/2000 Johnson
6,130,991 A * 10/2000 Chapman ..... 392/383
6,158,087 A 12/2000 Cheung
6,167,196 A 12/2000 Huggins, Jr. et al.
6,188,836 B1 2/2001 Glucksman et al.
6,220,065 B1 4/2001 Lee
6,286,500 B1 * 9/2001 Jones ..... 126/91 A
6,321,034 B2 * 11/2001 Jones-Lawlor et al. ..... 392/367
D459,453 S * 6/2002 Pannozzo et al. ..... D23/332
2001/0004010 A1 6/2001 Halm
2001/0005990 A1 7/2001 Kim et al.
2001/0028841 A1 * 10/2001 Huang et al. ..... 415/60

* cited by examiner

PORTABLE ELECTRIC SPACE HEATER

FIELD OF THE INVENTION

This invention relates to portable electric space heaters.

BACKGROUND OF THE INVENTION

Portable electric space heaters have long been used to provide heat, whether radiant, conductive and/or convective, to a local area. Electric space heaters commonly used in the home or office typically emit heat in a single, fixed direction, although some units are provided with an oscillating feature so that heat may be provided across an angular range of motion of the heater.

SUMMARY OF THE INVENTION

The inventors have appreciated that typical electric space heaters do not provide sufficient flexibility for a user to adjust where and how heat is provided in a particular area. For example, space heaters having a heat throw must be adjusted in position to provide heat to more than one area in a room. Oscillating-type space heaters can provide a changing heat throw direction, but persons near the heater may experience discomfort due to the constantly changing amount of heat in their area. That is, a person may feel warm while the oscillating heater is directed toward the person, but may feel cool when the heater is directed another way.

In at least one aspect of the invention, a portable air conditioning apparatus, such as a space heater, has at least two separable units that may be detached and positioned apart from each other. As a result, each of the units may be positioned to throw heat or otherwise condition air in a desired direction that is independent of a heat throw direction of the other unit(s). The separable units may be electrically connected and be supplied electric power by a common source. Thus, the units may be positioned to provide a constant heat source to two separate areas. The units may be separated from each other without the use of tools to allow a user to more easily configure the distribution of heat output of the units.

In another aspect of the invention, a portable space heater may have separable units that may be connected together and arranged to provide heat in two or more different directions. The directions in which heat is provided by the units may be adjustable, whether through a manually adjustable or automatically oscillating feature.

In one aspect of the invention, separable heat generating units in a portable space heater may be connected by magnetic latches, mechanical latches, a hinge arrangement, a bayonet-type connection, or any other suitable device or combination of devices.

In one aspect of the invention, separable heating units may be physically separated while remaining electrically connected to each other. In another aspect, the separable units may be both physically and electrically disconnected to provide two or more independent heating units.

These and other aspects of the invention will be apparent from the following detailed description and the appended claims.

BRIEF DESCRIPTION OF THE DRAWINGS

Illustrative embodiments in accordance with aspects of the invention are described below in conjunction with the following drawings in which like numerals reference like elements, and wherein.

DETAILED DESCRIPTION

As discussed above, illustrative embodiments in accordance with the invention provide a portable heater having two or more separable heating units that may be either connected together and operate as one contiguous unit, or be separated from each other and produce heat at separate, remote locations. The heating units may produce heat in any suitable way, such as radiant, convective and/or conductive heating. In one illustrative embodiment, the heating units include an electrically-powered heating element that heats air passed through the element. A fan may also be incorporated in each heating unit to move air past the heating element. Since the heating units that form the heater may be separated from each other, the heating units may be placed to throw heat in separate directions, thus eliminating the need for two or more autonomous heaters in some applications.

In one aspect of the invention, the separable heating units may be supplied with electric power by a common electrical connection or power source. For example, the heater may have a single plug and wire connector that may be connected to a common household outlet. Electrical power from the plug and wire connector may be supplied to all of the heating units in the heater through electrical connections between the units.

In another aspect of the invention, multiple heating units may be connected together in such a way that the direction in which the heating units each emit heat may be changed relative to each other. For example, two heating units may be joined by a hinge connection so that the units may be rotated relative to each other about the hinge and the directions that the units output heat adjusted relative to each other. Heating units may be connected by other rotary-type connections, such as a bayonet-type connection, that allows adjustment in the direction in which the heating units emit heat. The heating units may be connected in other ways that do not allow relative movement of the units, such as magnetic latches, mechanical latches, hook and loop fastening devices, detent mechanisms, and so on.

Figure 1:
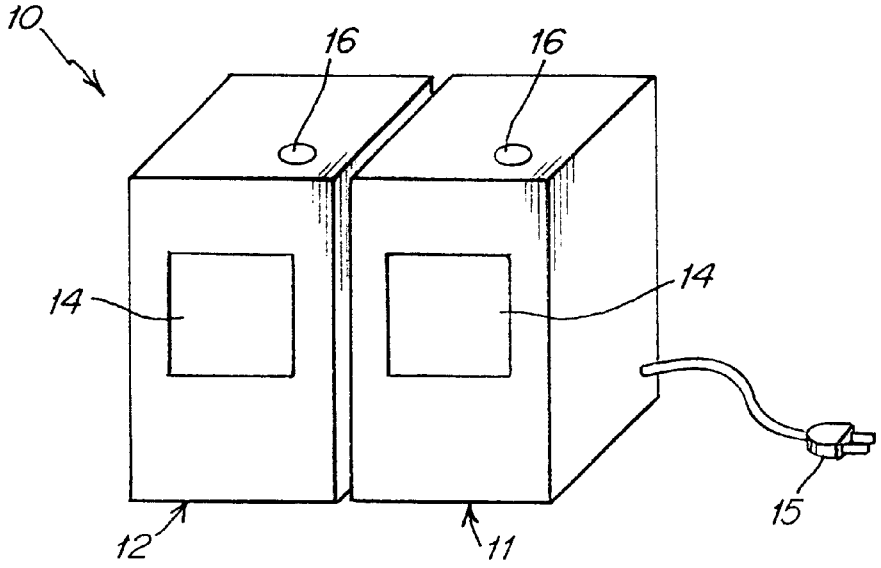
FIG. 1 is a schematic diagram of a portable heater in accordance with an aspect of the invention.

FIG. 1 shows an illustrative embodiment of a heating apparatus 10 that incorporates various aspects of the invention. The heating apparatus 10 includes a first heating unit 11 and a second heating unit 12 that are removably attached together. Each heating unit includes an air inlet (not shown) and an air outlet 14 arranged so that air may move through the units 11 and 12 from the air inlet to the air outlet 14. In this illustrative embodiment, the air inlet and air outlet 14 are positioned on opposite sides of the heating units 11 and 12, but any suitable arrangement of the air inlet and outlet 14 may be used. For example, the air inlet and air outlet 14 may be positioned on a same side of the heating units 111 and 12 or on adjacent sides, such as an air inlet on a top surface of the units 11 and 12 and the air outlet 14 on a front surface of the units 11 and 12.

In this illustrative embodiment, the heating units 11 and 12 include at least one heating element (not shown) that heats air as it moves from the air inlet to the air outlet 14. Any suitable type or arrangement of heating elements may be used, such as electrical resistance heaters, radiant heating devices, and so on. The heating units 111 and 12 may also include a fan or other device (not shown) that causes air to move from the air inlet past the heating element to the air outlet. Thus, each of the heating units 11 and 12 is constructed and arranged to heat air and output the heated air through the air outlet 14.

Although in this illustrative embodiment the heating units 11 and 12 are arranged to heat air, the heating units 11 and 12 may output heat in any suitable way, such as by convective, radiant and/or conductive means. Thus, the first and/or second heating units 11 and 12 may output heat in any suitable fashion. Moreover, the units 11 and 12 may be arranged to perform any suitable air conditioning function, including heating, moving (e.g., function as an air fan), humidifying, cooling, or any suitable combination of air conditioning functions. Thus, as used herein, the term "air conditioning" is not used to refer only to air cooling, but also any of the other functions mentioned above.

In this illustrative embodiment, the heating units 11 and 12 share a common electrical connector 15, which may be a plug and wire connector adapted to interface with a standard electrical wall outlet. Thus, both of the heating units 11 and 12 may be supplied with electrical power through the connector 15. Of course, it should be understood that the heating units 11 and 12 may share a common power supply, such as a battery, solar or fuel cell, or other power source that may be located within the housing of one or both of the heating units 11 and 12. Alternately, the heating units 11 and 12 may each have their own dedicated connector 15 or power source.

Figure 2:
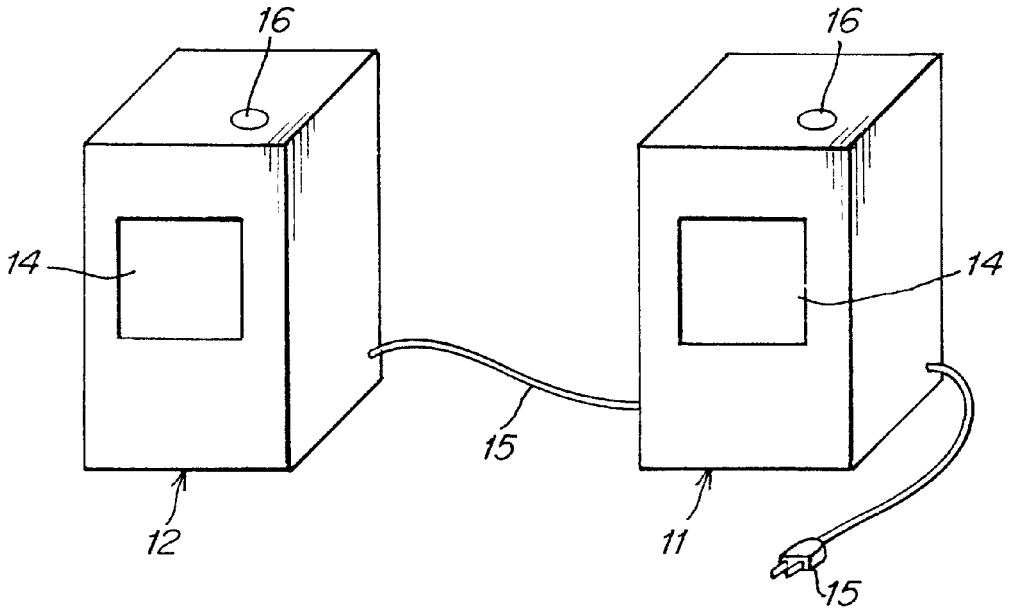
FIG. 2 shows separable heating units of the FIG. 1 embodiment positioned remote from each other.

The heating units 11 and 12 may also include controls 16 to control the operation of one or both of the heating units. The controls 16 may include rotatable knobs, depressable buttons, voice or sound actuated switches, or any other suitable device to control the operation of the units 11 and 12. In addition, in at least one embodiment, one set of controls 16, such as those on the first unit 11, may be used to control both of the units 11 and 12 when they are attached together, as in the condition shown in FIG. 1. Thus, a user may turn both units 11 and 12 on, adjust a temperature setting or air flow rate, or other operational features using a single set of controls 16, e.g., those on the first unit 11. The units 11 and 12 may include an electrical connector, sensor, or other device to detect when the units 11 and 12 are connected together so that one set of controls may override the other set of controls so both units 11 and 12 can be controlled by one set of controls. When the units are separated, as shown in FIG. 2, the controls 16 on each of the units 11 and 12 may be allowed to respectively control only the associated unit 11 or 12. Thus, once the units 11 and 12 are separated, controls 16 on the first unit 11 may be used to control the operation of the first unit 11 only, and controls 16 on the second unit 12 may be used to control only the operations of the second unit 12. The first and second units 11 and 12 may also include safety devices, such as temperature sensors, used to shut the heating element(s) off in high temperature conditions, e.g., when an air inlet 13 or air outlet 14 is obstructed or when one heating unit 11 directs heated air into the air inlet 13 of the other heating unit 12.

As also shown in FIG. 2, the connector 15 may also include a wire that transmits electrical power and/or control signals between the units 11 and 12 when they are separated. Thus, electrical power provided at the plug end of the connector 15 may be provided to the second heating unit 12. The wire or other device interconnecting the first and second heating units 11 and 12 may include a plug or other removable connection so that the second unit 12 may be unplugged from the first unit 11 and separated even more remotely from the first unit 11. The plug may be compatible with conventional wall outlets so that the second unit 12 may be plugged into a wall outlet independent of the first unit 11 or otherwise receive power separate from the first unit 11. Of course, the connection between the first and second units may be arranged so that the units 11 and 12 may not be detached from each other.

One aspect of the invention incorporated in the FIG. 1 embodiment is that the first and second heating units 11 and 12 may be removably attached from each other. Thus, the units may be attached and serve as a single, portable heater, or detached and serve as two separate heaters that require only one plug connector. When separated, the units 11 and 12 may provide heat to separate areas. For example, the units 11 and 12 may be separated and directed to each output heat toward persons located in separate areas of a room. The separated heating units 11 and 12 may be individually controlled to provide the desired air conditioning, such as different heat outputs, air flow rates, or other features. Such an arrangement may have advantages over oscillating heaters since an approximately constant output of heat may be directed toward a particular area, unlike oscillating heaters which change the direction in which heat is thrown. This is not to say, however, that each unit 11 and 12 may not have an oscillating feature. To the contrary, one or both of the units 11 and 12 may have an oscillating feature or otherwise change a direction in which heat is produced. Another potential advantage of this aspect of the invention is that a single heating apparatus may either be joined to heat one particular area, or separated into two or more heating units to heat two or more separate areas. Thus, it should be understood that although the FIG. 1 embodiment includes two heating units 11 and 12, the heating apparatus 10 may include three or more separable heating units.

Figure 3:
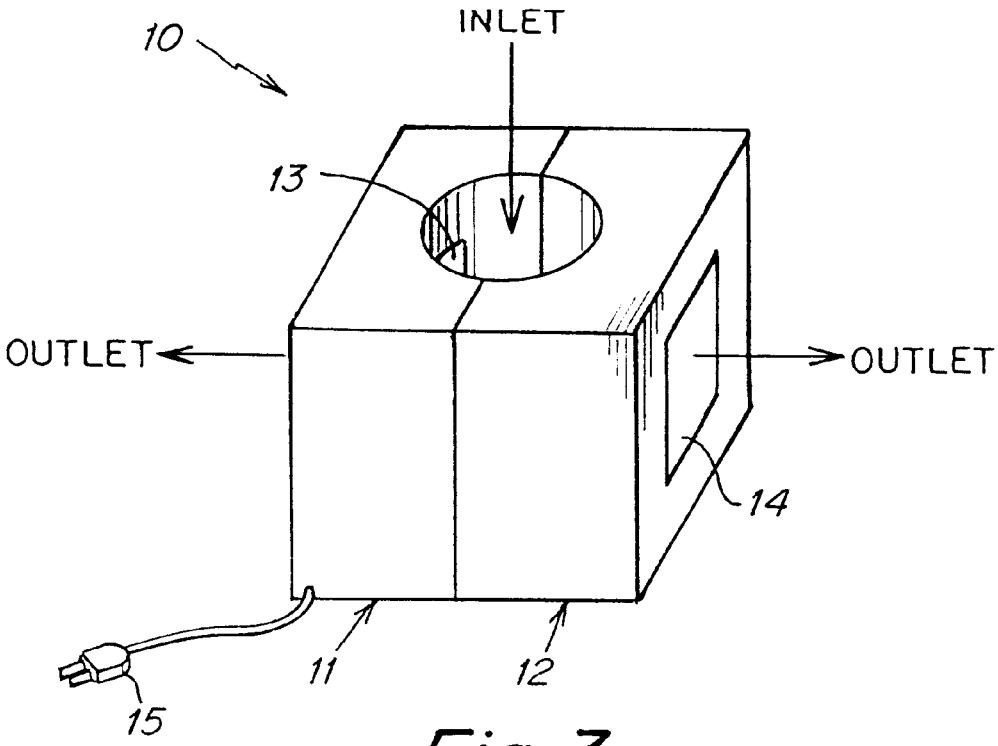
FIG. 3 is a schematic diagram of another illustrative embodiment of a portable heater in accordance with the invention.

FIG. 3 shows another illustrative embodiment of a heating apparatus 10 that incorporates various aspects of the invention. In this illustrative embodiment, two heating units 11 and 12 are arranged so that air entering the inlets 13 of the units 11 and 12 is provided through a common cavity formed by the units. That is, in this embodiment, the heating units 11 and 12 have a half-cylinder shaped area formed in the rear surfaces that mate together. When the units 11 and 12 are assembled as shown in FIG. 3, the half-cylinder shaped surfaces form an approximately circular air inlet for the apparatus 10 through which air may pass to the individual air inlets 13 of the units 11 and 12. In this embodiment, the units 11 and 12 also have oppositely facing air outlets 14 so that heat may be output in opposite directions. Again, it should be understood that although reference is made to heat output by the units 11 and 12, the units 11 and 12 may perform any suitable air conditioning function, such as air moving, cooling, humidifying, and others. In addition, the cavity formed between the units 11 and 12 may have any suitable shape and/or size.

Figure 4:
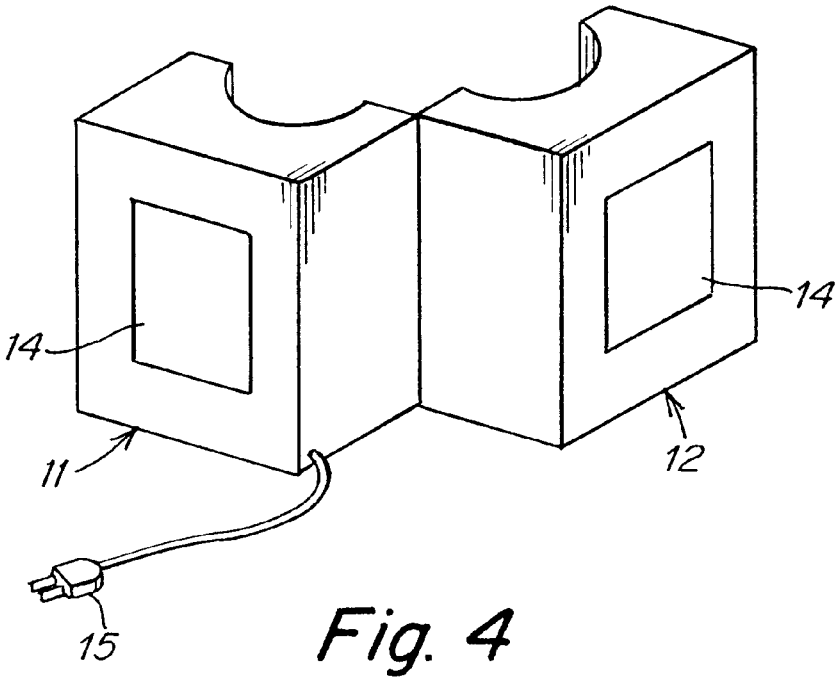
FIG. 4 is a schematic diagram of the FIG. 3 embodiment illustrating a hinged connection between heating units.

As in the FIG. 1 embodiment, the units 11 and 12 may be removably attached in any suitable way. In this illustrative embodiment, the units 11 and 12 are attached so that they may pivot relative to each other, for example, as shown in FIG. 4. Thus, the units 11 and 12 may be attached by a hinge or other device in a kind of clamshell-type arrangement. In this way, the units 11 and 12 may be pivoted relative to each other to provide different, or the same, direction of heat output.

Figure 5:
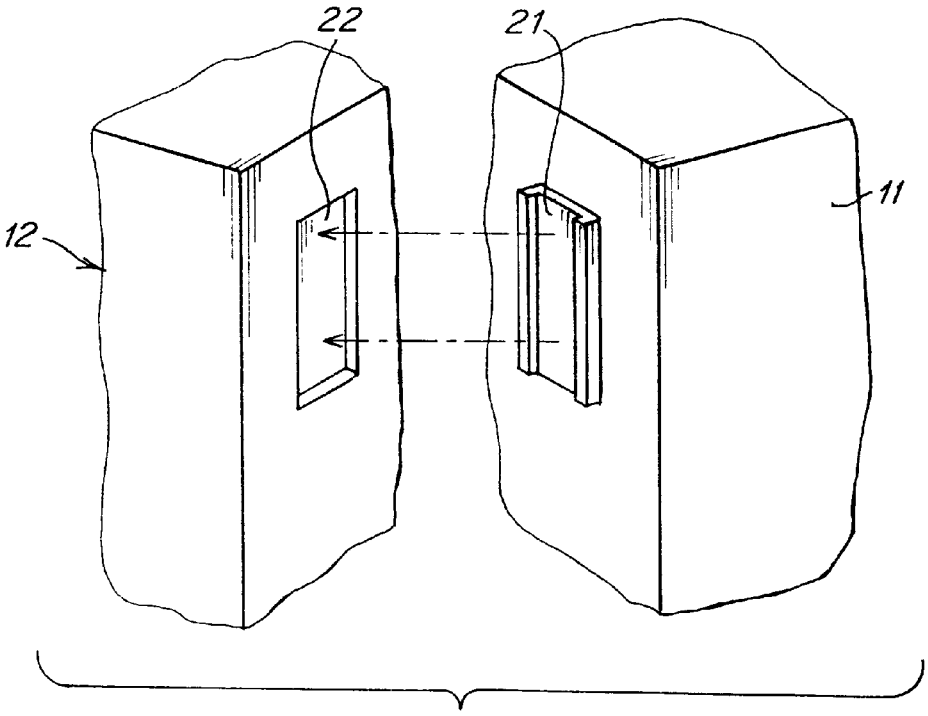
FIG. 5 shows an illustrative embodiment of a magnetic latch for interconnecting separable heating units.

As discussed above, the heating units in a heating apparatus may be removably attached in any suitable way. For example, FIG. 5 shows a magnetic latch that may be used to attach heating units such as those shown in FIGS. 1 and 3. In this illustrative embodiment, the first heating unit 111 has a magnetic latch 21 that may be formed in any suitable way. For example, the magnetic latch 21 may include a permanent magnet and magnetizable material, such as steel strips, to enhance the connection between elements of the magnetic latch as is well known. The second heating unit 22 may include a striker plate 22 made of a magnetizable material, such as a steel plate. Thus, when the magnetic latch 21 is brought into contact with the striker 22, the permanent magnet may attract the striker 22 and hold the units 11 and 12 together. In this embodiment, the magnetic latch 21 is raised from its mounting surface on the first unit 11, and the striker 22 is placed in a recess in the second unit 12. Thus, when the magnetic latch 21 and striker 22 are aligned and secured together, the magnetic latch 21 may fit within the recess holding the striker 22 and prevent relative sliding of the units 11 and 12. That is, the magnetic latch 21 may provide a locating function so that the units 11 and 12 are secured together in a desired alignment. It should be understood that the locating or alignment function may be provided in other ways. For example, the magnetic latch 21 and the striker 22 may have interlocking features to prevent sliding of the latch 21 and the striker 22 relative to each other.

Although only a single magnetic latch 21 is shown in FIG. 5, the units 11 and 12 may include any suitable number of magnetic latches or other devices to secure the units. For example, a magnetic latch may be provided at each of four corners of one surface of a unit that is mated with a corresponding surface on the other unit. In addition, the magnetic latch may be replaced by other devices, such as hook and loop fasteners, or other devices.

Figure 6:
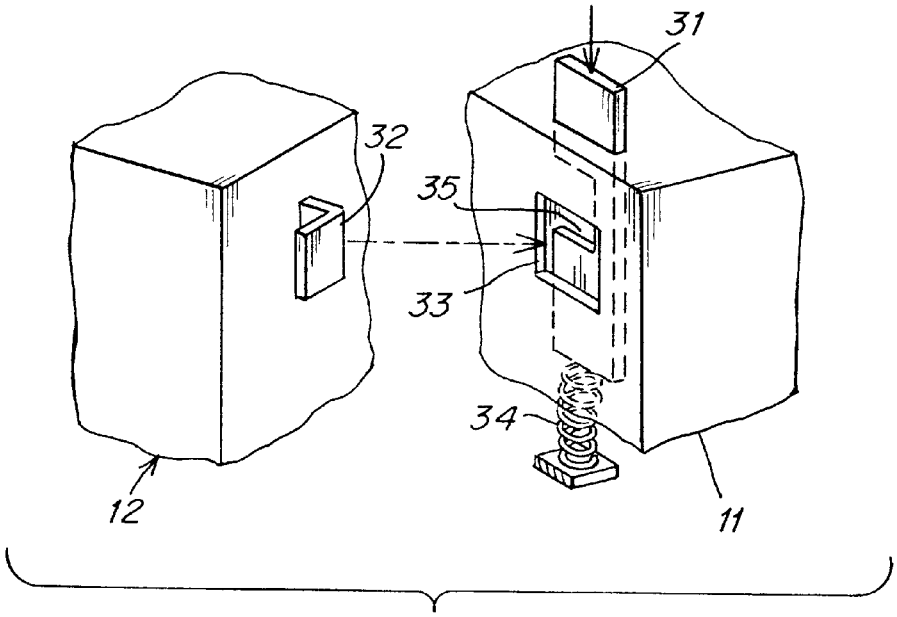
FIG. 6 shows an illustrative embodiment of a mechanical latch for interconnected separable heating units.

FIG. 6 shows an arrangement for a mechanical latch that may be used to interconnect heating units. In this illustrative embodiment, the mechanical latch includes a latch member 31 that is slidably mounted within the first unit 11. The latch member 31 may slide vertically, as shown in FIG. 6, so that a notch 35 in the latch member 31 may be aligned with an opening 33 in the housing of the first unit 11. A spring 34 biases the latch member 31 upward so that force must be applied and maintained in a downward direction on the latch member 31 to keep the notch 35 in alignment with the opening 33. The opening 33 and the notch 35 are sized to receive a hook 32 on the second unit 12. Thus, the first and second units 11 and 12 may be brought together so that the hook 32 extends through the opening 33 and the notch 35 while the latch member 31 is depressed. Once the latch member 31 is released, the spring 34 may bias the latch member 31 upward so that the hook 32 is engaged by the portion of latch member 31 below the notch 35. As a result, the first and second units 11 and 12 may be secured together. To disengage the first and second units 11 and 12, the latch member 31 may be depressed so that the notch 35 and opening 33 are aligned and the hook 32 is released. As with other connection arrangements, two or more mechanical latches may be used to interconnect housing units in a heater assembly 10. Further, the arrangement shown in FIG. 6 is only one illustrative embodiment of a mechanical latching arrangement. It will be understood that a variety of other configurations may be used.

Figure 7:
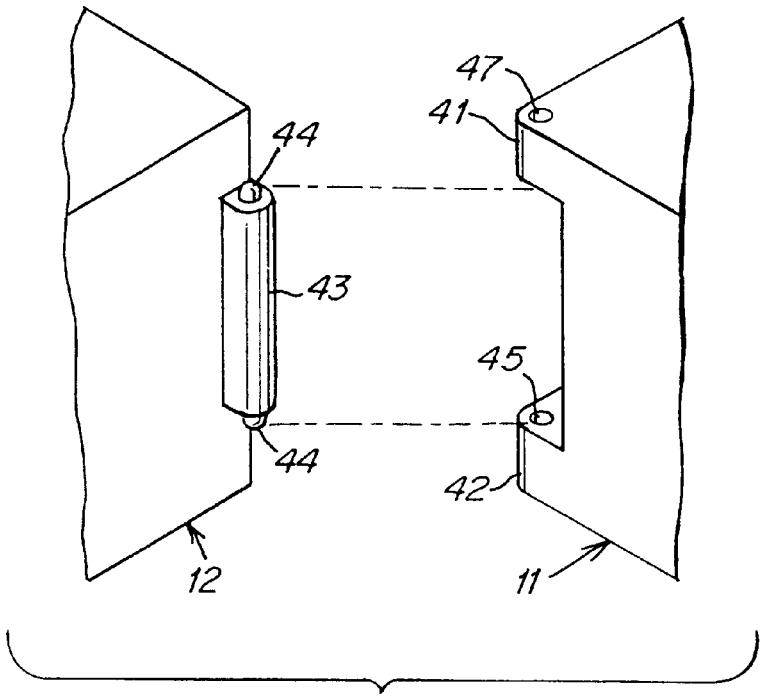
FIG. 7 shows an illustrative embodiment of a hinge connection for interconnecting separable heating units.

FIG. 7 shows another connection arrangement for heating units in accordance with an aspect of the invention. In this illustrative embodiment, the first heating unit 11 has a pair of hinge knuckles 41 and 42 respectively positioned at top and bottom ends of the unit 11. The second heating unit 12 has a hinge knuckle 43 with hinge pins 44 extending from opposite ends of the knuckle 43. These hinge pins engage with corresponding recesses 45 in the hinge knuckles 41 and 42 so that the first and second heating units 11 and 12 may be rotatably connected together. That is, the second heating unit 12 may be rotated about the pins 44 relative to the first heating unit 11. For example, the hinge arrangement shown in FIG. 7 may be used in the FIG. 3 embodiment to rotatably connect the first and second heating units 11 and 12.

Figure 8:
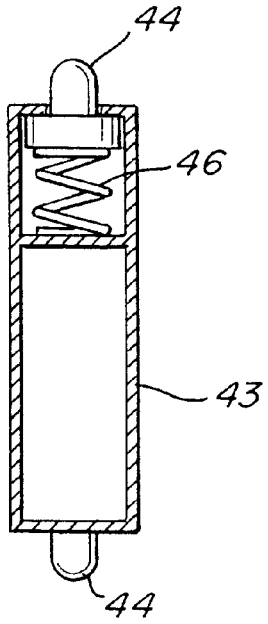
FIG. 8 shows a cross-sectional view of a hinge knuckle for use in the FIG. 7 embodiment.

The FIG. 7 hinge arrangement may be arranged in a variety of ways to provide a removable connection between the units. For example, FIG. 8 shows a cross-sectional view of the hinge knuckle 43. In this illustrative embodiment, the lower hinge pin 44 is fixed to the hinge knuckle 43, but the upper hinge pin 44 may move axially. A spring 46 urges the upper hinge pin 44 to extend from the hinge knuckle 43, but allows a user to depress the upper hinge pin 44 so it can disengage a recess 45. Thus, the first and second heating units 11 and 12 may be connected by first inserting the lower hinge pin 44 into the corresponding recess 45 on the hinge knuckle 42, then depressing the upper hinge pin 44 so that the hinge knuckle 43 may be positioned between the hinge knuckles 41 and 42 on the first unit 11. Once the knuckle 43 is properly positioned, the now released upper hinge pin 44 is urged into the recess 45 in the hinge knuckle 41. To separate the units 11 and 12 apart, the upper hinge pin 44 may be depressed so that it disengages from the recess in the knuckle 41 and the hinge knuckle 43 may be removed from the first unit 11. The upper hinge pin 44 may be depressed, for example, by inserting a finger through a hole 47 in the upper hinge knuckle 41 and manually depressing the hinge pin 44, or by lifting up unit 12 to compress the spring 46.

It will be understood that the hinge arrangement in FIG. 7 need not necessarily provide a rotatable connection between units 11 and 12. Instead, the arrangement in FIG. 7 may be used to interconnect the first and second units 11 and 12 in a fixed orientation. Furthermore, the hinge pins 44 need not be depressable so that they withdraw into the hinge knuckle 43 to allow disengagement of the units 11 and 12. Instead, the hinge pins 44 may be fixed in place and the hinge knuckles 41, 42 and 43 engaged in other ways. For example, one of the hinge knuckles 41 or 42 may be flexibly or otherwise movably mounted on the first unit 11 so that the knuckle 41 or 42 may be moved to allow insertion of the hinge knuckle 43. In addition, the first and second heating units 11 and 12 may be joined by two or more hinge arrangements, such as that shown in FIG. 7.

In another aspect of the invention, heating units in a heating assembly may be attached so that the relative directions in which the units output heat may be adjusted. In the illustrative embodiment shown in FIG. 9, two cylindrically-shaped heating units 11 and 12 are stacked so that the second heating unit 12 is on top of the first heating unit 11. The heating units 11 and 12 are attached so that the second heating unit 12 may be rotated relative to the first heating unit 11. Thus, the orientations of the air outlets 14 of the units 11 and 12 may be adjusted relative to each other in any suitable way. In addition, the heating units 11 and 12 may be separated from each other, as shown in FIG. 10.

Figure 9:
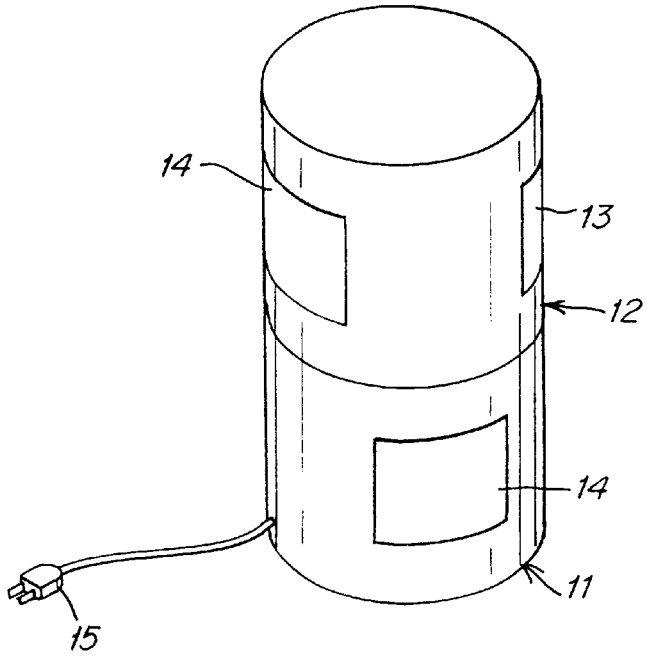
FIG. 9 shows a third illustrative embodiment of a heater in accordance with the invention.
Figure 10:
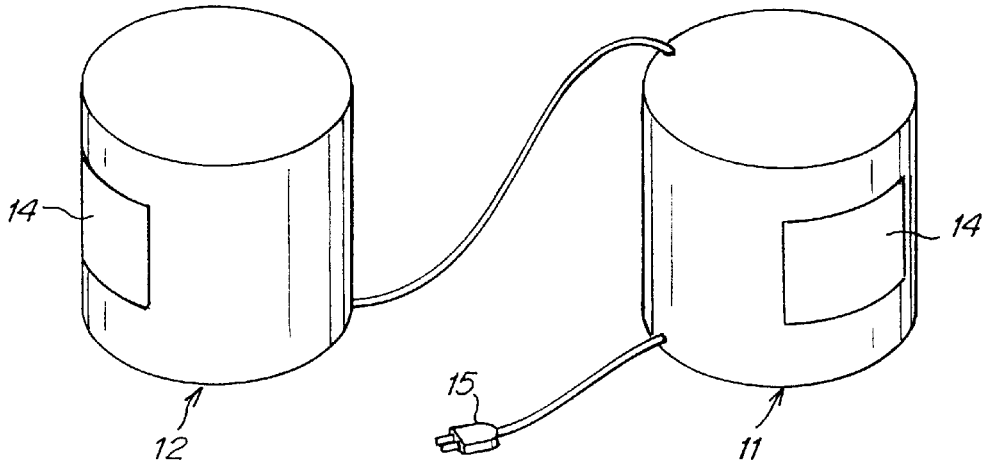
FIG. 10 is a schematic diagram of the FIG. 9 embodiment with the heating units separated from each other.

The connection between the heating units in the FIG. 9 embodiment may be arranged in any suitable way, e.g., to allow rotational adjustment in the relative positions of the units 11 and 12 when connected together. For example, the units 11 and 12 may be connected at corresponding ends by a bayonet-type connection shown in the illustrative embodiment of FIG. 11. In this embodiment, the first heating unit 11 includes a raised cylindrical portion 51 with tabs 52 extending from the upper sides of the cylindrical portion 51. These tabs are arranged to fit within notches 53 in the second heating unit 12. These notches 53 communicate with slots 54 that extend arcuately around a cylindrical recess 55 in the second unit 12. The cylindrical recess 55 is sized to receive the cylindrical portion 51 on the first unit 11. Thus, the first and second units 11 and 12 may be interconnected by aligning the tabs 52 with the recesses 53 and placing the second unit 12 over the first unit 11. The second unit 12 may then be rotated relative to the first unit 11, e.g., clockwise, so that the tabs 52 engage with the arcuate slots 54. By engaging with the arcuate slots 54, the tabs 52 may prevent the first and second units 11 and 12 from being disconnected unless the tabs 52 are aligned with the notches 53. The slots 54 may have detent features or other mechanisms to lock the first and second units 11 and 12 in discrete rotational positions relative to each other. The slots 54 may thus allow the first and second units 11 and 12 to be rotatably adjusted relative to each other, thereby adjusting the directions of relative heat output. An electrical cord 15*a* that interconnects the first and second units 11 and 12 may be received within the raised cylindrical portion 51 when the first and second units 11 and 12 are attached. Alternately, the cord 15*a* may be retracted within one or both of the units 11 and 12, e.g., by a spring loaded cord retractor.

Figure 11:
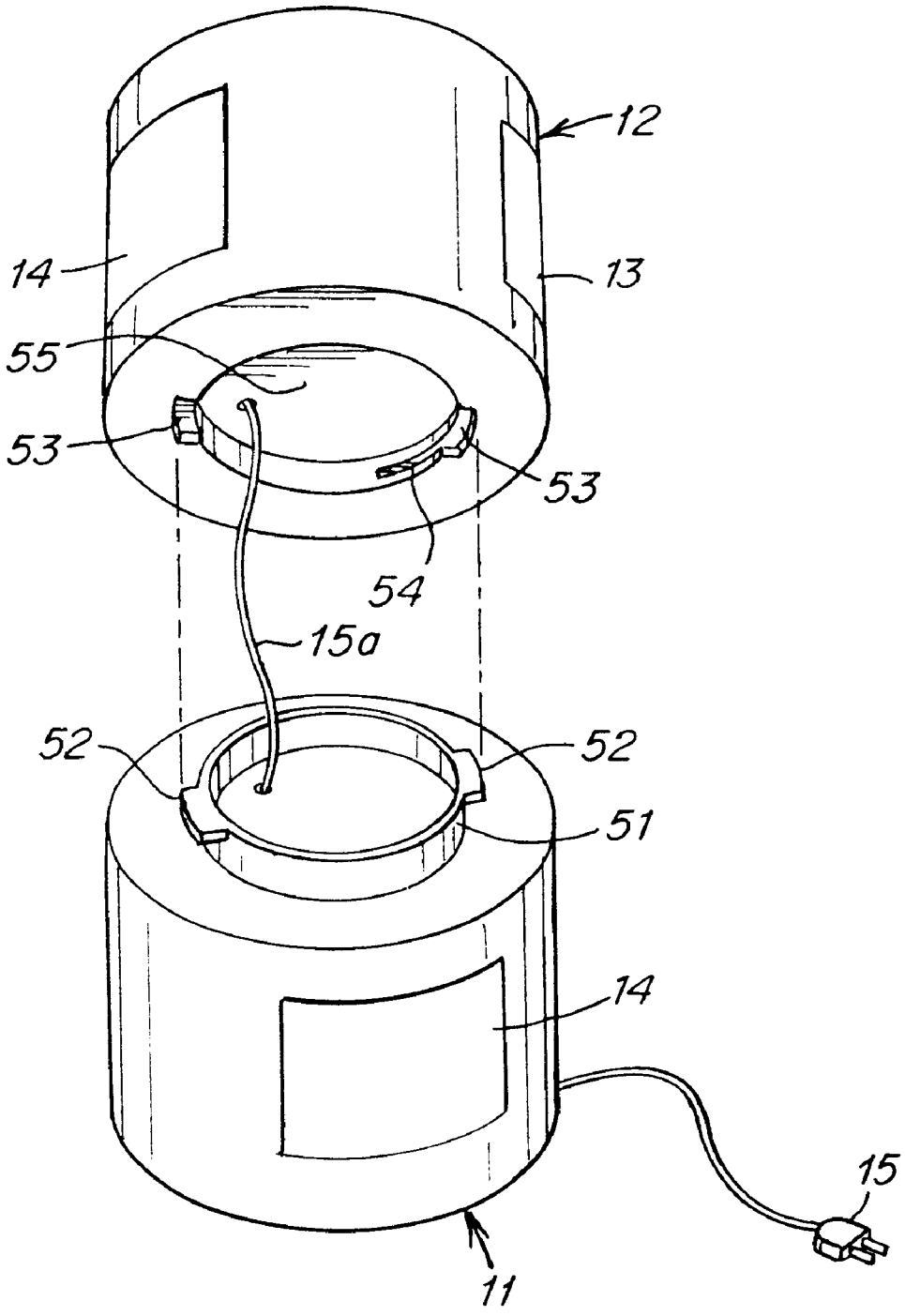
FIG. 11 shows an illustrative embodiment of a bayonet-type connection for interconnecting separable heating units.

It should be understood that the illustrative embodiment of a bayonet-type connection shown in FIG. 11 is only one example, and a bayonet-type connection may be provided by other structural arrangements. Further, although the air inlet 13 and air outlet 14 are shown at opposite sides of the units each of 11 and 12, the air inlet and outlet 13 and 14 may be positioned in any suitable location.

While the invention has been described on conjunction with specific embodiments, many alternatives, modifications and variations will be apparent to those skilled in the art. Accordingly, embodiments set forth herein are intended to be illustrative of the various aspects of the invention, not limiting. Various changes may be made without departing from the spirit and scope of the invention.

What is claimed is:

1. A portable electric heating apparatus, comprising:

a first heating unit including a housing and an electric heating element constructed and arranged to generate and output heat; and ,a second heating unit including a housing and an electric heating element constructed and arranged to generate and output heat, the housings of the first and second heating units being removably attached together, wherein the first and second heating units share an electrical connector that is constructed and arranged to provide electric power to the first and second heating units, and are operable to generate and output heat when attached to each other and when detached from each other, and are constructed and arranged so that the directions in which the first and second heating units output heat can be selectively adjusted relative to each other while the first and second heating units are attached together.

2. The apparatus of claim 1, wherein the first and second heating units are constructed and arranged to heat air.

3. The apparatus of claim 1, wherein each of the first and second heating units comprises:

a housing having an air inlet and an air outlet;

an electric heating element; and a fan that causes air to move from the air inlet, past the heating element to the air outlet.

4. The apparatus of claim 1, wherein the first and second heating units are adapted to be separated without using tools.

5. The apparatus of claim 1, further comprising at least one of a hinge, a magnetic latch, and a mechanical latch that removably attaches the first and second heating units together.

6. The apparatus of claim 1, further comprising a hinge that removably attaches the first and second heating units together, the hinge including a first knuckle attached to the first heating unit and a second set of knuckles on the second heating unit, the first knuckle having at least one retractable hinge pin that engages one of the second set of knuckles on the second heating unit.

7. The apparatus of claim 1, further comprising a bayonet connection that removably attaches the first and second heating units together.

8. The apparatus of claim 7, wherein the bayonet connection comprises a set of tabs extending from the first heating unit and a set of recesses on the second heating unit that receive the tabs on the first heating unit.

9. The apparatus of claim 1, wherein the second heating unit comprises an electrical connector that can be disconnected from the first heating unit.

10. The apparatus of claim 1, wherein the first and second heating units are constructed and arranged to allow selective adjustment of the relative directions of heat output by the first and second heating units while the first and second heating units are attached together.

11. The apparatus of claim 1, wherein the first and second heating units each include controls to respectively control the operation of the first and second heating units.

12. The apparatus of claim 1, wherein the first and second heating units share a common air inlet.

13. The apparatus of claim 1, wherein each of the first and second heating units includes an approximately cylindrically-shaped housing having opposite ends, and the first and second heating units are removably attached at corresponding ends of the approximately cylindrically-shaped housings.

14. The apparatus of claims 13, further comprising a bayonet connection that removably attaches the housings together.

15. The apparatus of claim 13, wherein the first and second heating units may be rotated relative to each other while being removably attached.

16. The apparatus of claim 13, wherein each of the first and second heating units have an air inlet and an air outlet positioned between opposite sides of the approximately cylindrically-shaped housing.

17. The apparatus of claim 13, wherein each of the first and second heating units comprises an electrical resistance heating element and a fan that causes air to move past the electrical resistance heating element.

18. The portable electric heating apparatus of claim 1, wherein the first and second electric heating elements are not lightbulbs.

19. The portable electric heating apparatus of claim 1, wherein each of the electric heating elements further comprises an air inlet, an air outlet, and a fan located between the air inlet and the air outlet.

20. A portable electric heating apparatus comprising:

first and second heating units constructed and arranged to generate and output heat, the first and second heating units being removably attached so that directions in which the first and second heating units output heat can be selectively adjusted relative to each other while the first and second heating units are attached together, wherein the first and second heating units are operable to generate and output heat when attached to each other and when detached from each other and share an electrical connector that is constructed and arranged to provide electric power to the first and second heating units.

21. The apparatus of claim 20, wherein the first and second heating units are constructed and arranged to heat air.

22. The apparatus of claim 20, wherein each of the first and second heating units comprises:

a housing having an air inlet and an air outlet;

an electric heating element; and a fan that causes air to move from the air inlet, past the heating element to the air outlet.

23. The apparatus of claim 20, wherein the first and second heating units are adapted to be separated without using tools.

24. The apparatus of claim 20, further comprising a bayonet connection that removably attaches the first and second heating units together.

25. The apparatus of claim 24, wherein the bayonet connection comprises a set of tabs extending from the first heating unit and a set of recesses on the second heating unit that receive the tabs on the first heating unit.

26. The apparatus of claim 20, wherein the first and second heating units each include controls to respectively control the operation of the first and second heating units.

27. The apparatus of claim 20, wherein each of the first and second heating units includes an approximately cylindrically-shaped housing having opposite ends, and the first and second heating units are removably attached at corresponding ends of the approximately cylindrically-shaped housings.

28. The apparatus of claim 27, further comprising a bayonet connection that removably attaches the housings together.

29. The apparatus of claim 27, wherein the first and second heating units may be rotated relative to each other while being removably attached.

30. The apparatus of claim 27, wherein each of the first and second heating units have an air inlet and an air outlet positioned between opposite sides of the approximately cylindrically-shaped housing.

31. The apparatus of claim 27, wherein each of the first and second heating units comprises an electrical resistance heating element and a fan that causes air to move past the electrical resistance heating element.

32. The apparatus of claim 20, wherein each of the first and second heating units comprises:

a housing having an air inlet and an air outlet; and wherein the first and second heating units are adapted to be arranged so that the air inlets of the first and second heating units draw air from opposite directions.

33. The apparatus of claim 20, wherein each of the first and second heating units comprises:

a housing having an air inlet and an air outlet; and wherein the first and second heating units are adapted to be arranged so that the air outlets of the first and second heating units output air in opposite directions.

34. A portable air conditioning apparatus, comprising:

first and second air conditioning units constructed and arranged to condition air and each including a housing, the housings of the first and second air conditioning units removably attached together so that the first and second air conditioning units share a common air inlet.

35. The apparatus of claim 34, wherein each of the first and second air conditioning units include a housing with a back surface, and the back surfaces of the first and second conditioning units are abutted and form the common air inlet.

36. The apparatus of claim 35, wherein the back surfaces have recesses that together form the common air inlet.

37. The portable electric heating apparatus of claim 20, wherein the first and second heating units do not include a lightbulb to generate heat.

38. The portable electric heating apparatus of claim 20, wherein each of the heating units further comprises an air inlet, an air outlet, and a fan located between the air inlet and the air outlet.

* * * * *